US005581916A

United States Patent [19]

Hirose et al.

[11] Patent Number: 5,581,916

[45] Date of Patent: Dec. 10, 1996

[54] EXCAVATING, SIEVING AND GRADING DEVICE FOR WORKING CRAWLER

[75] Inventors: Takahiro Hirose, Gifu-ken; Keizo Takahashi, Tokyo, both of Japan

[73] Assignee: Hirose Co., Inc., Gifu-ken, Japan

[21] Appl. No.: 466,011

[22] Filed: Jun. 6, 1995

[30] Foreign Application Priority Data

Jul. 11, 1994 [JP] Japan ..... 6-181841

[51] Int. Cl.[6] ..... E02F 3/40

[52] U.S. Cl. ..... 37/444; 37/445; 37/901; 37/904; 414/722; 209/421

[58] Field of Search ..... 37/901, 903, 904, 37/445, 444, 314, 316, 142.5, 379; 171/18, 136; 414/722–4, 912; 209/337, 342, 421; 404/121, 124; 305/1, 4

[56] References Cited

U.S. PATENT DOCUMENTS

| | | | |
|---|---|---|---|
| 1,114,097 | 10/1914 | Bell | 209/342 |
| 3,395,798 | 8/1968 | Erickson | 209/269 |
| 3,461,968 | 8/1969 | Longley | 209/241 |
| 3,640,386 | 2/1972 | Frangos | 209/337 |
| 4,188,288 | 2/1980 | Wehner | 209/342 |
| 4,664,791 | 5/1987 | McClain et al. | 209/421 |
| 5,100,539 | 3/1992 | Tsutsumi | 209/243 |
| 5,160,034 | 11/1992 | Potter | 37/904 |
| 5,222,828 | 6/1993 | Magalski | 404/124 |
| 5,360,288 | 11/1994 | O'Neill et al. | 404/121 |

FOREIGN PATENT DOCUMENTS

| | | | |
|---|---|---|---|
| 0015633 | 9/1980 | European Pat. Off. . | |
| 2412663 | 8/1979 | France | 209/421 |
| 133481 | of 1990 | Japan | E02F 3/40 |
| 125850 | of 1991 | Japan | E02F 3/36 |

OTHER PUBLICATIONS

PCT International Publication No. WO 94/24376, Date: Oct. 27, 1994.

*Primary Examiner*—Terry Lee Melius
*Assistant Examiner*—Tom A. Beach
*Attorney, Agent, or Firm*—Nikaido, Marmelstein, Murray & Oram LLP

[57] ABSTRACT

Disclosed is an excavating, sieving and grading device for a working crawler arranged such that each pair of first and second right and left legs 14, 14*a* and 17, 17*a* are vertically disposed to a bucket main body 7, the first right and left legs are connected to each other by a first reinforcing member 15, the second right and left legs are connected to each other by a second reinforcing member 18, and first and second guide rollers 16, 19 for supporting and guiding a first guide rail 21 disposed on the bottom surface of a movable frame 12 are provided on the first and second reinforcing members. With this arrangement, the movable frame provided with the sieve net is stably supported and guided to the bucket main body to thereby increase the strength of the excavating, sieving and grading device.

19 Claims, 7 Drawing Sheets

EXCAVATING, SIEVING AND GRADING DEVICE FOR WORKING CRAWLER

BACKGROUND OF THE INVENTION

1. Field of the Invention

The present invention relates to an excavating, sieving and grading device mounted as an attachment on a working crawler such as a hydraulic shovel as an example of construction machines, an agricultural tractor as an example of agricultural machines, and the like.

2. Description of the Related Art

In general, an excavating, sieving and grading device, which has an excavating function for excavating mud, grit, soil broken in a construction field, and the like and a sieving and grading function for sieving and grading the excavated material, is mounted on a working crawler such as a hydraulic shovel and the like as an attachment. Such an excavating, sieving and grading device is known from Japanese Utility Model Application Laid-Open No. 2(1990)-133481 and Japanese Utility Model Application Laid-Open No. 3(1991)-125850. The excavating, sieving and grading devices disclosed in these publications are arranged such that the bottom surface of a bucket main body mounted on an arm and having an excavating function is opened and a movable frame which is provided with a sieve net and reciprocatingly movable in a horizontal direction is attached to the opening, so that excavated material is sieved and graded by the horizontal reciprocating movement of the movable frame.

The movable frame of these excavating, sieving and grading devices is reciprocatingly moved in such a manner that guide rails integrally provided with the both right and left sides of the movable frame are supported and guided by guide rollers disposed on the both right and left side walls of the bucket main body.

Although the movable frame must be so strong as to endure the total weight of an excavated material placed on the sieve net, when the movable frame is supported only on the both right and left edges thereof, the weight of the frame cannot help being increased to provide the frame with a strength sufficient to prevent the downward deflection of the central portion of the frame. Thus, a large drive unit corresponding to the heavy movable unit is required to drive the movable frame.

Moreover, although a countermeasure for sufficiently increasing the strength of the bucket main body which supports the heavy movable frame is required, since it is indispensable to arrange the bucket main body as a bottomless structure with the opening defined to the bottom surface thereof, an employable countermeasure is only to increase the wall thickness of the side walls of the bucket main body. With such a countermeasure for increasing the strength, however, the wall thickness must be considerably increased to enable the bucket main body to support the movable frame which moves in the horizontal direction, and thus there arises a problem that the size and weight of the excavating, sieving and grading device are more increased as a whole.

Further, the aforesaid conventional excavating, sieving and grading device also has a problem that although the sieve net sieves and grades excavated material by moving in the horizontal direction forwardly and backwardly, when the excavated material is wet, the material adheres to the meshes of the sieve net and is liable to cause clogging. When clogging is caused, a sieving and grading function is lowered and thus workability is greatly lowered.

SUMMARY OF THE INVENTION

According to the present invention made to provide an excavating, sieving and grading device for a working crawler, taking the above situation into consideration to remove the above drawbacks, an excavating, sieving and grading device for a working crawler is provided which includes a bucket main body swingably mounted at the extreme end of the arm of the working crawler and having an excavating blade formed at the front end thereof. A movable frame is forwardly and backwardly movably disposed to the bottom opening of the bucket main body. A sieve net is provided on the movable frame. A drive unit is provided on a rear end of the bucket main body for forwardly and backwardly reciprocatingly moving the movable frame. A pair of first right and left legs are vertically disposed to the rear half portion of the bucket main body, where the movable frame is located at all times, of the bucket main body integrally therewith. The first right and left legs are connected to each other by a first reinforcing member. A first support and guide member for supporting and guiding the bottom surface of the movable frame is provided on the first reinforcing member.

According to another aspect of the present invention, there is provided an excavating, sieving and grading device for a working crawler which includes a bucket main body swingably mounted at the extreme end of the arm of the working crawler and having an excavating blade formed at the front end thereof. A movable frame is forwardly and backwardly movably disposed to the bottom opening of the bucket main body. A sieve net is provided on the movable frame. A drive unit is provided on a rear end of the bucket main body for reciprocatingly moving the movable frame forwardly and backwardly. Pairs of first and second right and left legs are vertically disposed to the rear half portion of the bucket main body, where the movable frame is located at all times, of the bucket main body integrally therewith. The first right and left legs are connected to each other by a first reinforcing member and the second right and left legs are connected to each other by a second reinforcing member. First and second guide rollers for supporting and guiding a guide rail disposed on the bottom surface of the movable frame are provided on the first and second reinforcing members. A third guide roller is rotatably supported by a lateral shaft and is disposed on the front half portion of the movable frame. The third guide roller is rollably supported and guided by a second guide rail provided on the bucket main body. A fourth guide roller is rotatably supported by a vertical shaft on the bucket main body and rollably abutted against the right and left sides of the movable frame.

According to the present invention, there is further provided an adhered material removing member disposed above the sieve net and removing a material adhered to the sieve net on the bucket main body.

With this arrangement, the present invention effectively increases the strength of the excavating, sieving and grading device by stably supporting and guiding the movable frame and further securely prevents clogging.

DESCRIPTION OF PREFERRED EMBODIMENTS

Figure 1:
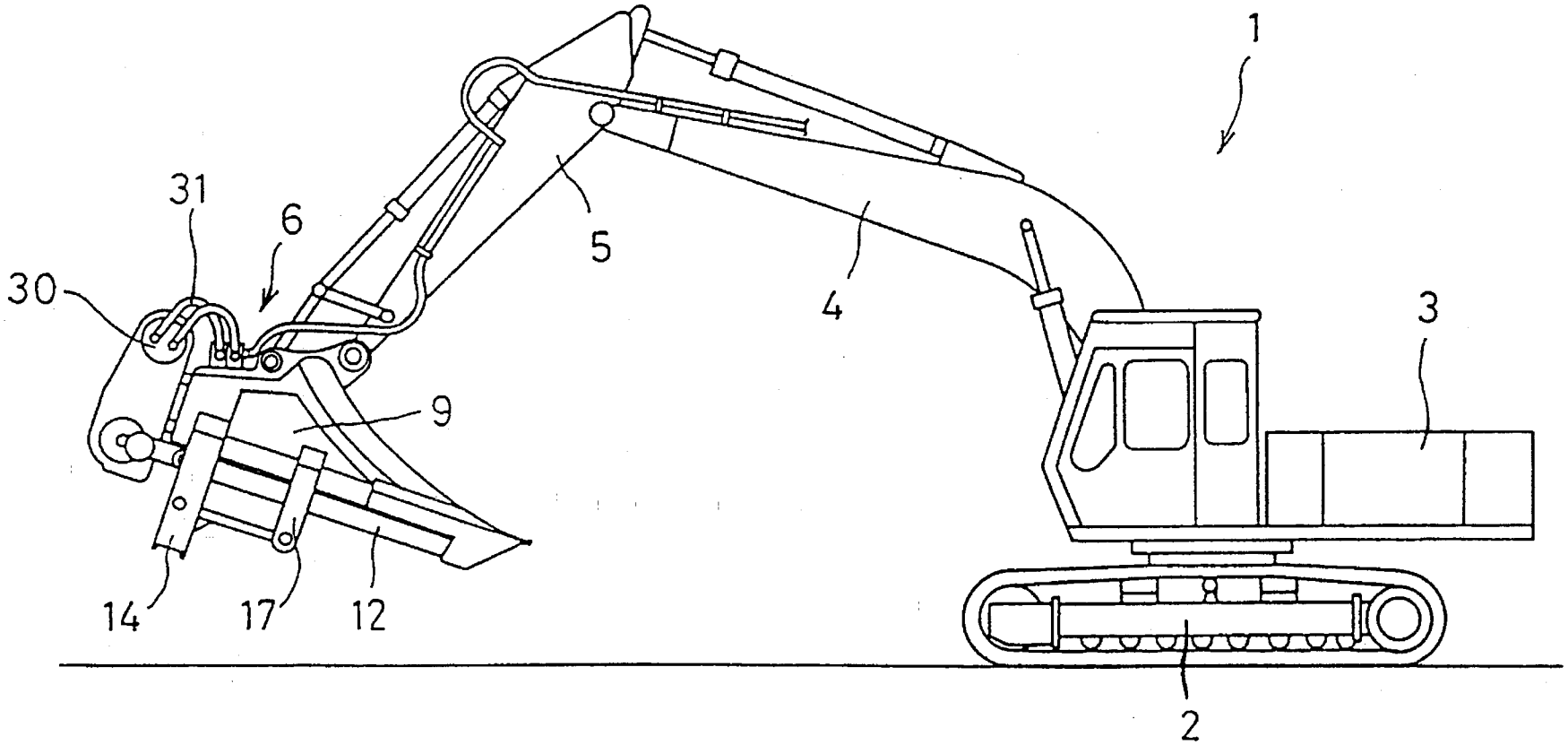
FIG. 1 is side elevational view of a hydraulic shovel.
Figure 2:
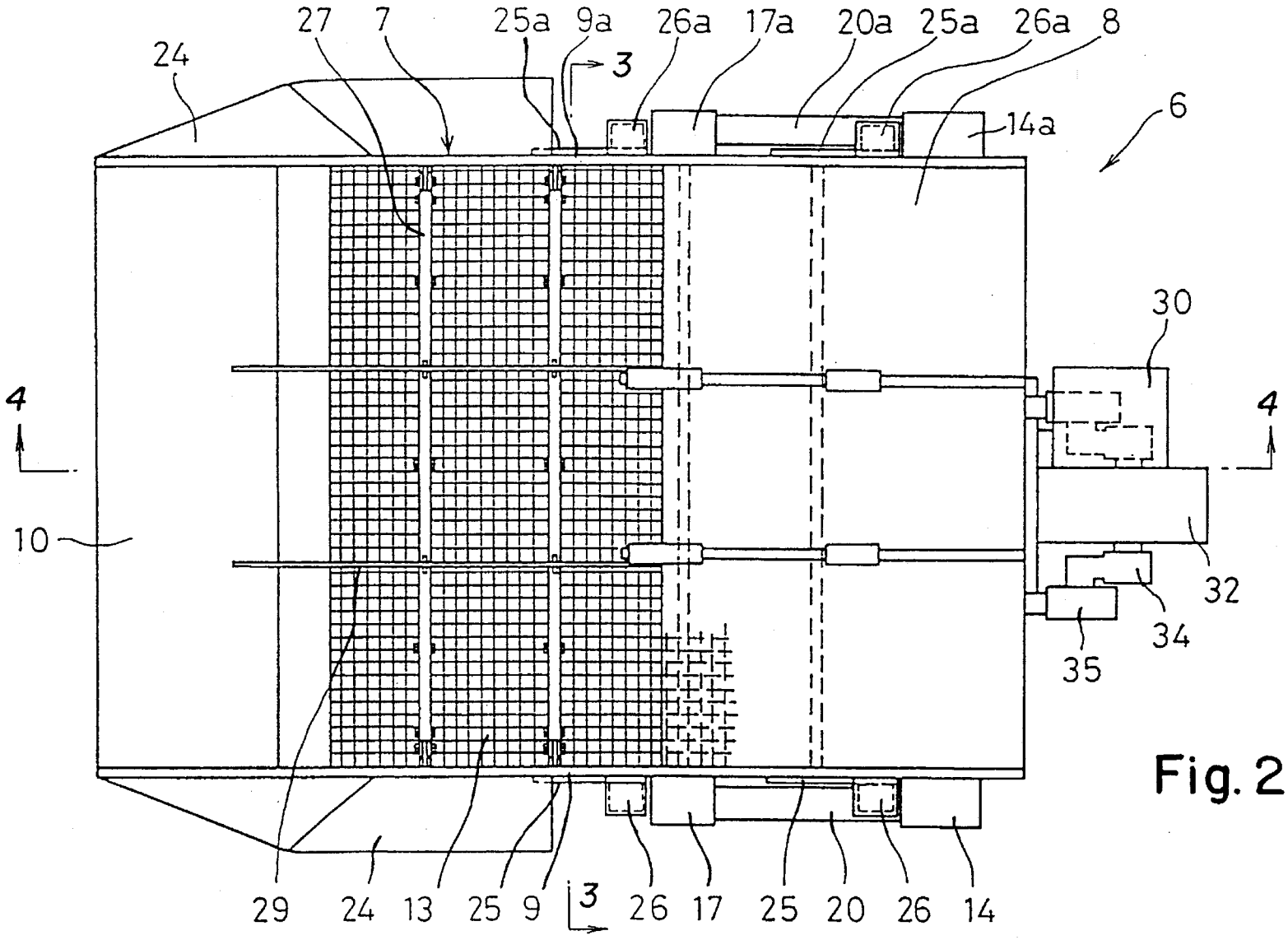
FIG. 2 is a plan view of an excavating, sieving and grading device.
Figure 3:
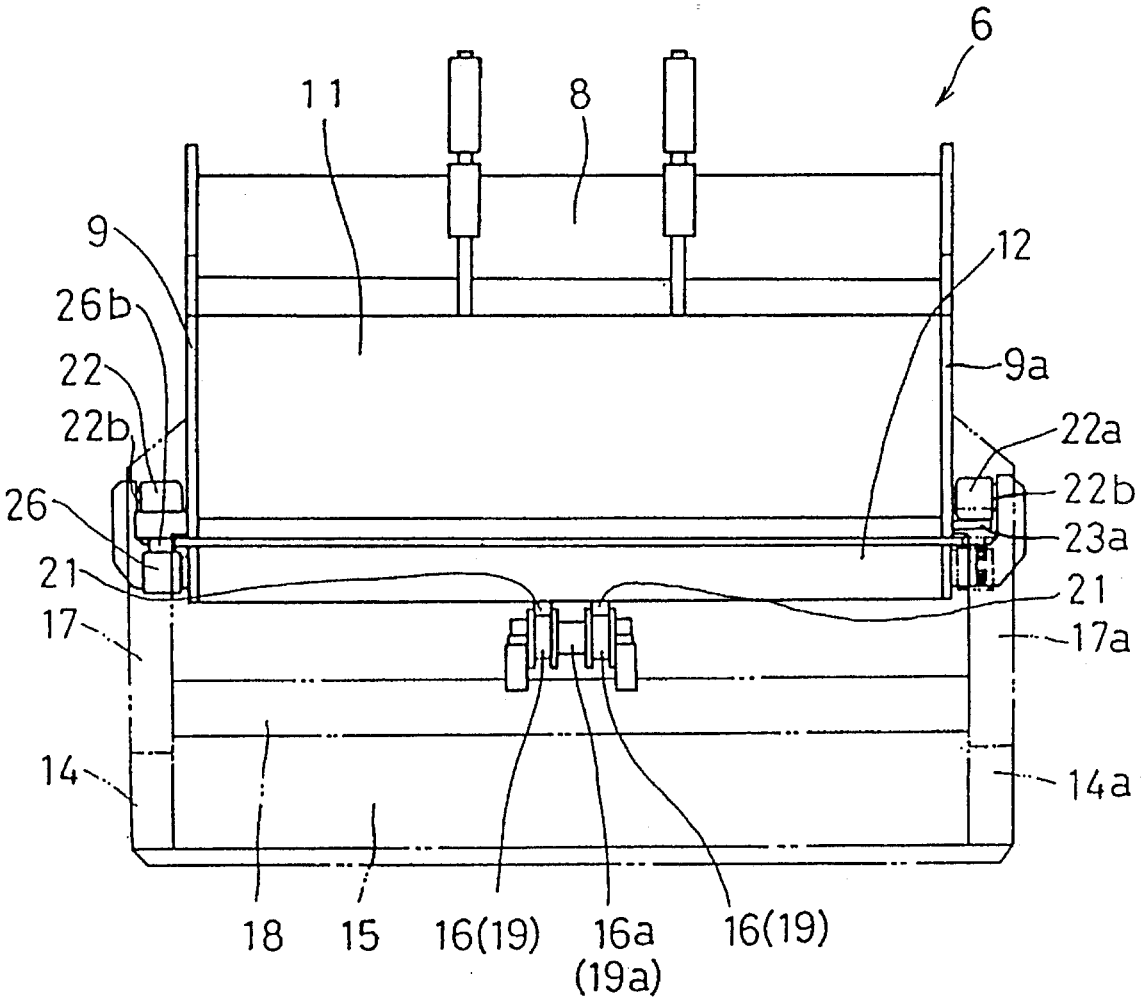
FIG. 3 is a partially omitted backside view of the excavating, sieving and grading device.
Figure 4:
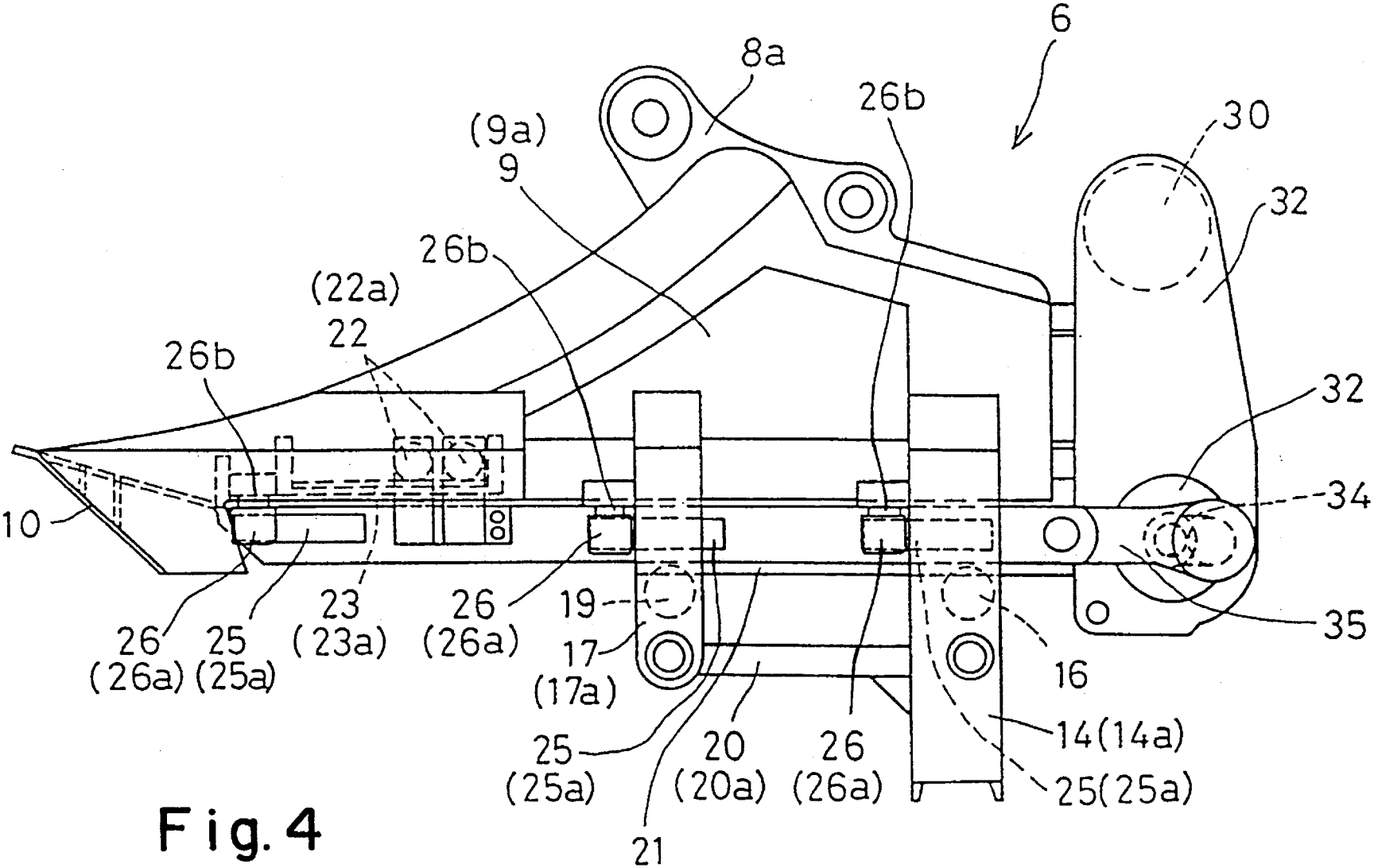
FIG. 4 is a side elevational view of the excavating, sieving and grading device when a movable frame moves backwardly.

An embodiment of the present invention will be described below with reference to the drawings. In FIG. 1, a hydraulic shovel 1 is composed of respective components of a crawler type traveling body 2, a turning body 3 supported on the traveling body 2 so that it can turns freely, a boom 4 upwardly and downwardly swingably mounted at the frond end of the turning body 3, an arm 5 forwardly and backwardly swigably connected to the extreme end of the boom 4 and the like. These respective components are hydraulically driven by the power of an engine (not shown) mounted on the rear portion of the turning body 3 similarly to a conventional hydraulic shovel, and an excavating, sieving and grading device 6 to be described later is mounted at the extreme end of the arm 5.

The excavating, sieving and grading device 6 has a bucket main body 7 as a primary component. The bucket main body 7 is formed to a bucket shape with an open bottom by a roof plate 8 forwardly and backwardly swingably supported at the extreme end of the arm 5 through a bracket 8*a*, right and left side walls 9, 9*a* projecting at an acute angle forwardly of the front end of the roof plate 8, an excavating blade 10 interposed between the front ends of the right and left side walls 9, 9*a*, a rear wall 11 on which drive unit such as a hydraulic motor or the like to be described later is mounted.

A rectangular movable frame 12 is disposed on the bottom opening of the bucket main body 7 so that it can reciprocatingly move forwardly and backwardly in a horizontal direction. The movable frame 12 is formed to a grid shape by a four-side frame 12*a* and a plurality of partitions 12*b* extending in forward and backward directions and right and left directions. A sieve net 13 is detachably stretched on the upper surface of the movable frame 12. Soil, sand and the like excavated by the excavating blade 10 can be sieved and graded as the movable frame 12 reciprocatingly, forwardly and backwardly moves in the horizontal direction. The movable frame 12 is reciprocatingly movably supported and guided by the bucket main body 7 as described below.

That is, a pair of first right and left legs 14, 14*a* are vertically disposed at the rear portion the right and left side walls 9, 9*a* of the bucket main body 7 integrally therewith so that a sieving and grading job can be carried out when that the lower ends of the first legs 14, 14*a* are in contact with the ground and a first reinforcing member 15 is interposed between the first legs 15, 14*a*. A first guide roller 16 is rotatably supported by a lateral shaft 16*a* at the central portion in the right to left direction above the upper surface of the first reinforcing member 15 and is disposed at a position which is located below the rear half portion of the movable frame 12 even if the movable frame 12 moves to the foremost side.

Figure 5:
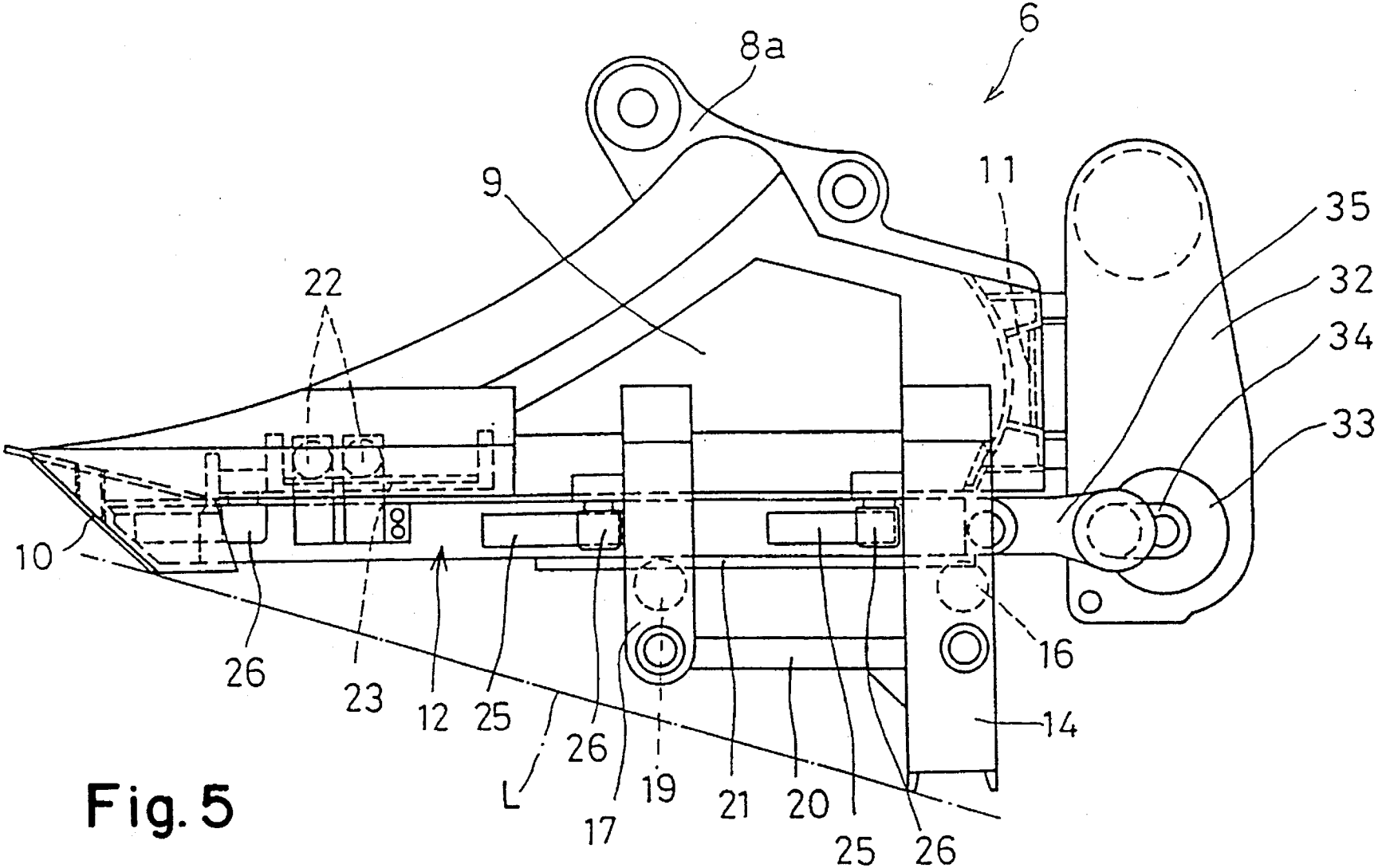
FIG. 5 is a side elevational view of the excavating, sieving and grading device when the movable frame moves forwardly.
Figure 6:
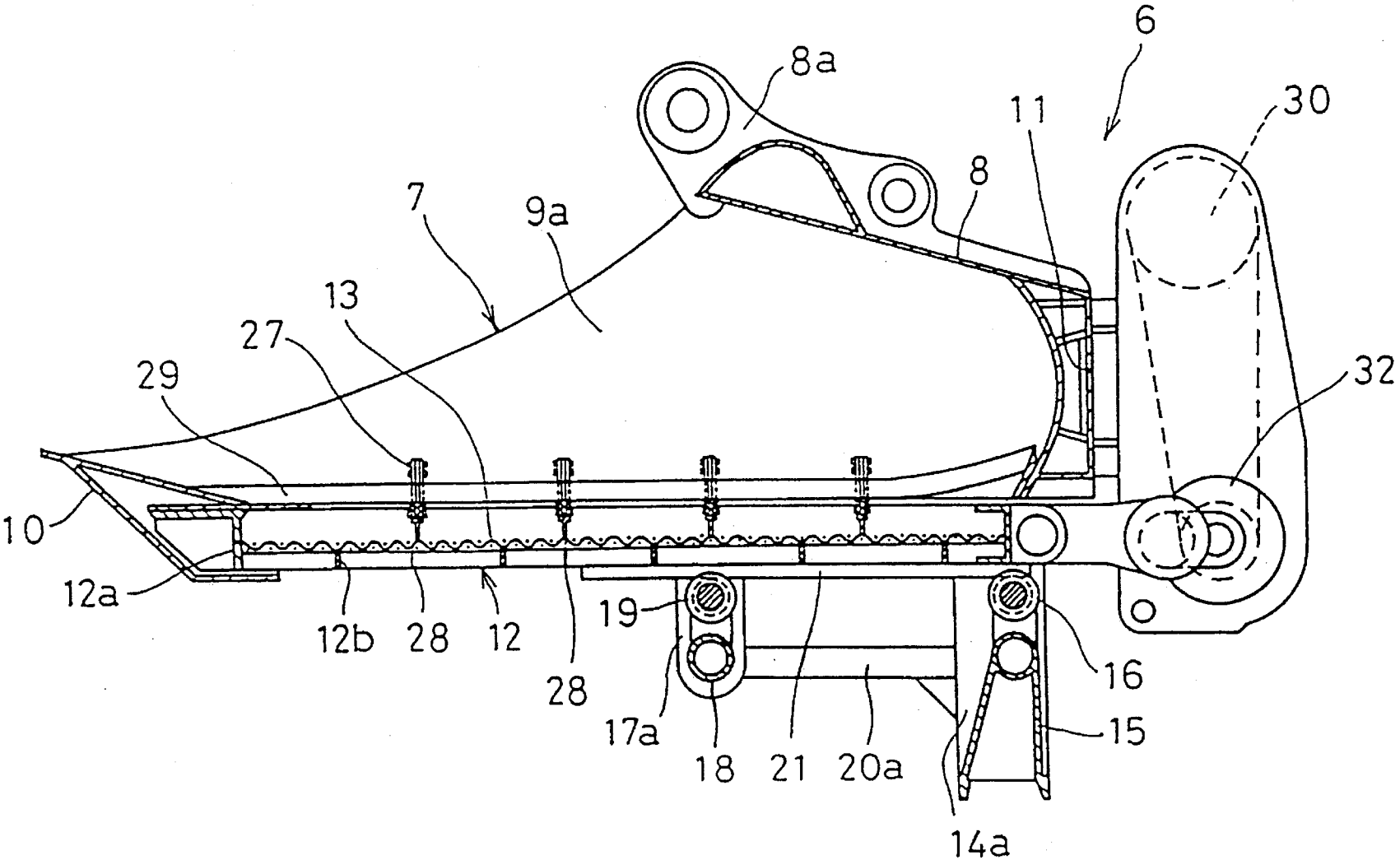
FIG. 6 is a cross sectional view taken along the line A—A of FIG. 2.
Figure 7:
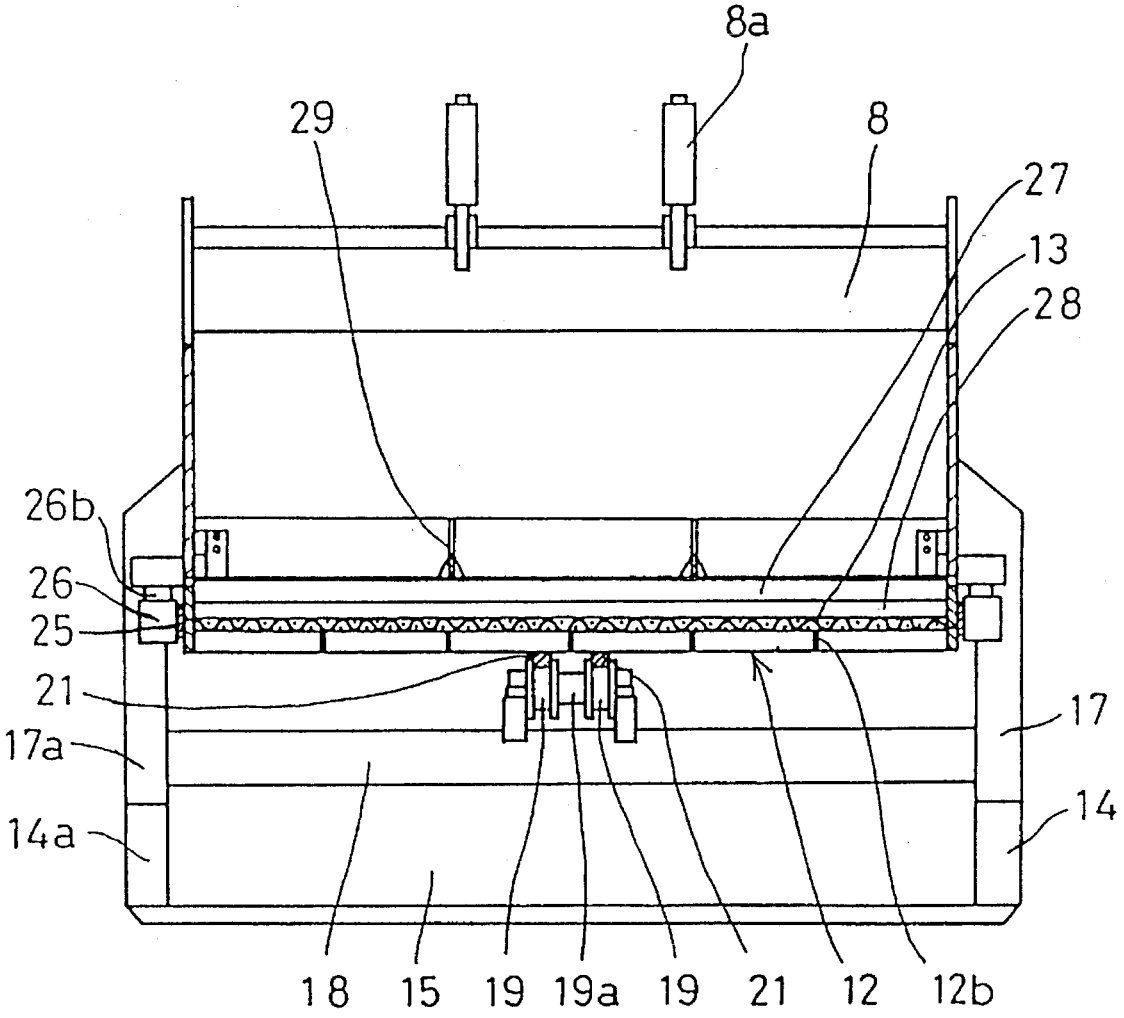
FIG. 7 is a cross sectional view taken along the line B—B of FIG. 2.

A pair of second right and left legs 17, 17*a* which are shorter than the first legs 14, 14*a* are vertically disposed substantially at the central portion in the forward to backward direction of the right and left side walls 9, 9*a* of the bucket main body 7 integrally therewith. A second reinforcing member 18 is interposed between the second right and left legs 17, 17*a*. A second guide roller 19 having the same shape as that of the first guide roller 16 is rotatably supported by a lateral shaft 19*a* at the central portion in the right to left direction above the upper surface of the second reinforcing member 18. Further, the first left leg 14 is connected to the second left leg 17 through a third reinforcing member 20. The first right leg 14*a* is connected to the second right leg 17*a* through a third reinforcing member 20*a*. The vertically downward length of the second legs 17, 17*a* are set such that the lower ends of the second legs 17, 17*a* are located above the imaginary line (a dot-dash-line L in FIG. 5) connecting the lower end of the excavating blade 10 to the lower end of the first legs 14, 14*a* (on the bottom side of the movable frame 12) so that the second legs 17, 17*a* do not obstruct an excavating job.

A guide rail 21 extending in the forward to backward direction is disposed at the central portion in the right to left direction of the bottom surface of the movable frame 12 at the rear half portion thereof and is engaged with first and second guide rollers 16 and 19. With this arrangement, the rear half portion of the movable frame 12 is forwardly and backwardly movably supported and guided with respect to the bucket main body 7 at the central portion in the right to left direction of the bottom surface of the frame 12. Incidentally, the guide rail 21 is fixed integrally to the lower surface of the partitions 12*b*.

A pair of third right and left guide rollers 22, 22*a* are rotatably supported by a lateral shaft 22*b* on the front half side of both the right and left sides of the movable frame 12 so that the guide rollers 22, 22*a* project outwardly and upwardly. A pair of second right and left guide rails 23, 23*a* extending in the forward to backward direction are disposed on the front half portion of the right and left side walls 9, 9*a* of the bucket main body 7. The third guide rollers 22, 22*a* are rollably engaged with the second right and left guide rails 23, 23*a*. With this arrangement, the front half portion of the movable frame 12 is forwardly and backwardly movably supported and guided with respect to the bucket main body 7 on the right and left sides of the frame.

A cover member 24 covering the second guide rails 23, 23*a* is disposed outwardly of the front half side of the right and left side walls 9, 9*a* of the bucket main body 7 integrally therewith, whereby the second guide rails 23, 23*a* are protected in an excavating job and, in addition, the bucket main body 7 is reinforced.

A total of six pieces of fourth guide rollers 26, 26*a* are disposed to the right and left side walls 9, 9*a* of the bucket main body 7 and are abutted against guide members 25, 25*a* disposed of the right and left outer sides of the movable frame 12. Fourth guide rollers 26, 26*a*, are rotatably supported by vertically mounted shafts 26*b*. With this arrangement, the lateral vibration of the movable frame 12 in the right and left directions can be prevented.

A plurality of support levers 27 extend in the right to left direction and are interposed between the right and left side walls 9, 9*a* of the bucket main body 7. An elastic rubber member 28 having a lower end in sliding contact with the sieve net 13 is fixed to each of the support levers 27 so that soil, sand and the like adhered to the sieve net 13 can be removed by the elastic rubber member 28. A pair of reinforcing levers 29 are attached to the bucket main body 7 in the forward to backward direction thereof to reinforce the support levers 27.

A hydraulic motor 30 is disposed on the rear portion of the rear wall 11 of the bucket main body 7. The hydraulic motor 30 is driven by operating fluid supplied thereto through a hydraulic piping 31 and has an output shaft which is coupled with a follower sprocket 33 through a chain power transmission mechanism (not shown) contained in a power transmission case 32. The rear end of an actuating piece 35 whose extreme end is rotatably supported by the rear side of the movable frame 12 is rotatably supported at the extreme end of a crank lever 34 integrally coupled with the follower sprocket 33. When the hydraulic motor 30 is driven to rotate the follower sprocket 33, the actuating piece 35 is reciprocatingly swung forwardly and backwardly so that the movable frame 12 is forwardly and backwardly reciprocatingly moved in the horizontal direction.

Since the embodiment of the present invention is arranged as described above, the excavating, sieving and grading device 6 can carry out the function of excavating mud, grid, soil broken in a construction field and the function of sieving and grading the excavated material. Although the sieving and grading job is carried out by forwardly and backwardly reciprocatingly moving the movable frame 12 provided with the sieve net 13 in the horizontal direction, the movable frame 12 can be supported and guided with respect to the bucket main body 7 in a secure and stable state in this case.

More specifically, the bottom surface of the rear half portion of the movable frame 12 is supported and guided by the first and second guide rollers 16, 19 provided on the first reinforcing member 15 interposed between the first legs 14, **14*a* of the bucket main body 7 and the second reinforcing member 18 interposed between the second legs 17, 17*a* thereof as described above. Both the right and left sides of the front half portion of the movable frame 12 are supported and guided by the second guide rails 23, 23*a* provided on the right and left walls 9, 9*a* of the bucket main body. As a result, the movable frame 12 is forwardly and backwardly reciprocatingly moved in a secure and stable state because not only both the right and left sides of the movable frame 12 but also the bottom surface thereof are supported and guided with respect to the bucket main body 7. Consequently, the downward deflection of the movable frame 12 at the central portion thereof, which is caused by the weight of an excavated material placed on the sieve net 13 as in the case of a conventional movable frame supported only on the right and left sides thereof, can be avoided without the need of particularly strengthening the movable frame 12. In this manner, the weight of the movable frame 12 itself can be reduced, and in addition, the size of the drive unit such as the hydraulic motor 30** and the like can be also reduced.

In the arrangement of this embodiment, since the downward deflection of the movable frame 12 at the central portion thereof can be avoided as described above, a gap defined between the movable frame 12 and the bucket main body 7 by such deflection and the problem of the movable frame 12 being swung in the right and left directions can be almost totally prevented. Further, since the swing of the movable frame 12 in the right and left directions can be prevented by the fourth guide rollers 26, **26*a* provided with both the right and left walls 9, 9*a* of the bucket main body 7, the movable frame 12 can be moved forwardly and backwardly in a smooth state without any swings to the right and left and unintentional strikes against the right and left walls 9, 9*a* of the bucket main body 7**.

Since the weight of the movable frame 12 and the drive unit can be reduced and further that the swinging of the movable frame 12 to the right and left and striking against the right and left walls 9, **9*a* are prevented as described above, this embodiment is advantageous in strength. However, this embodiment is made further advantageous in strength by the first and second legs 14, 14*a*, 17 and 17*a* vertically disposed on the bucket main body 7, the first and second reinforcing members 15, 18 interposed between the right and left legs, the third reinforcing members 20, 20*a* interposed between the front and rear legs and the cover member 24 covering the front half portion of the right and left side walls 9, 9*a***.

Even if wet soil, sand and the like are adhered to the sieve net 13, since the adhered material can be removed by the rubber elastic members 28 which extend to the right and left directions, i.e., the direction substantially perpendicular to the direction toward which the sieve net 13 moves and the lower end of the rubber elastic members are disposed to be in slide contact with the sieve net 13, the clogging of the sieve net 13 can be securely prevented and thus an excellent sieving and grading function can be exhibited for a long time.

The adhered material removing member of the present invention is not limited to a rubber elastic member but also a brush such as a wire brush or the like may be used. When the brush is arranged as a rotary brush rotated by the reciprocating movement of the movable frame and the extreme end portion of the rotary brush is formed to such a length as to pass through the sieve net, there is also an advantage that the damage of the brush can be avoided as well as an action for more positively removing an adhered material can be exhibited.

In short, since the present invention is arranged as described above, although a sieving and grading job is carried out by forwardly and backwardly reciprocatingly moving the movable frame provided with the sieve net, the bottom surface of the movable frame is supported and guided by the first supporting and guiding member provided with the first reinforcing member connecting the first right and left legs vertically disposed to the rear half portion of the bucket main body to each other in this case. As a result, the forwardly and backwardly reciprocating movement of the movable frame is securely and stably carried out in the state that the bottom surface of the movable frame is supported and guided with respect to the bucket main body. Consequently, the downward deflection of the movable frame at the central portion thereof, which is caused by the weight of excavated material placed on the sieve net 13 as in the case of the conventional movable frame supported only on the right and left sides thereof, can be avoided without the need of particularly strengthening the movable frame 12, so that the weight of the movable frame itself can be reduced as well as the size of the drive unit for moving the movable frame can be also reduced.

When the second right and left legs are vertically disposed to the bucket main body and the second support and guide member for supporting and guiding the bottom surface of the movable frame is provided with the second reinforcing member connecting the second legs to each other, the movable frame can be forwardly and backwardly reciprocatingly moved more smoothly.

The bucket main body itself is made advantageous in strength by the first and second legs and the reinforcing member connecting the legs to each other.

Further, when the adhered material removing member is disposed above the sieve net, since a material adhered to the sieve net can be removed by it, the clogging of the sieve net can be securely prevented and thus an excellent sieving and grading function can be exhibited for a long time.

What is claimed is:

1. An excavating, sieving and grading device for a working crawler comprising a bucket main body swingably mountable at an extreme end of an arm of the working crawler; an excavating blade formed at a front end of said bucket main body; a movable frame forwardly and backwardly movable disposed on a bottom opening of said bucket main body; a sieve net provided on said movable frame; a drive unit connected to said movable from and mounted on said bucket main body for forwardly and backwardly reciprocatingly moving the movable frame; a pair of first right and left legs vertically disposed on a rear half portion of said bucket main body, said movable frame being located at all times integrally on said bucket main body; a first reinforcing member connecting said first right and left legs to each other in such a manner that the first reinforcing member passes under said sieve net; and a first support and guide member provided on said first reinforcing member for supporting and guiding the bottom surface of said sieve net attached to said movable frame.

2. An excavating, sieving and grading device for a working crawler according to claim 1, further comprising a pair of second right and left legs vertically disposed on said bucket main body at a position forwardly of said first legs; a second reinforcing member connecting said second legs to each other; and a second support and guide member for supporting and guiding the bottom surface of said movable frame provided on said second reinforcing member.

3. An excavating, sieving and grading device for a working crawler according to claim 2, wherein said first and second support and guide members comprise first and second guide rollers.

4. An excavating, sieving and grading device for a working crawler according to claim 3, further comprising a first guide rail guided on said first and second guide rollers and being disposed on the bottom surface of said movable frame.

5. An excavating, sieving and grading device for a working crawler according to claim 2, further comprising third reinforcing members connecting said first and second front and rear legs to each other.

6. An excavating, sieving and grading device for a working crawler according to claim 4, further comprising a pair of lateral shafts attached to sides of a front half portion of said movable frame; third guide rollers rotatably supported by said lateral shafts; and second guide rails on said bucket main body with said third guide rollers rollably supported and guided thereon.

7. An excavating, sieving and grading device for a working crawler according to claim 6, further comprising vertical shafts on said bucket main body; fourth guide rollers rotatably supported by said vertical shafts and rollably abutted against right and left sides of said movable frame.

8. An excavating, sieving and grading device for a working crawler according to claim 7, further comprising third reinforcing members connecting said first and second front and rear legs to each other.

9. An excavating, sieving and grading device for a working crawler according to claim 1, further comprising an adhered material removing member provided on said bucket main body located above said sieve net and removing a material adhered to said sieve net.

10. An excavating, sieving and grading device for a working crawler according to claim 9, wherein said adhered material removing member comprises a support lever interposed between right and left inner walls of said bucket main body, and a rubber elastic member integrally provided on said support lever and having a lower extreme end in sliding contact with said sieve net.

11. An excavating, sieving and grading device for a working crawler according to claim 9, wherein said adhered material removing member comprises a support lever interposed between right and left inner walls of said bucket main body, and a brush provided on said support lever.

12. An excavating, sieving and grading device for a working crawler comprising a bucket main body swingably mountable at an extreme end of an arm of the working crawler; an excavating blade formed at a front end of said bucket main body; a movable frame forwardly and backwardly movably disposed on a bottom opening of said bucket main body; a sieve net provided on said movable frame; a drive unit connected to said movable frame and mounted on said bucket main body for reciprocatingly moving the movable frame forwardly and backwardly; pairs of legs, wherein each pair comprises a right and left leg vertically disposed on a rear half portion of said bucket main body in corresponding locations on opposite sides of said bucket main body; said movable frame being located at all times integrally on said bucket main body; a first reinforcing member connecting said first right and left legs to each other; a second reinforcing member connecting said second right and left legs to each other; a first guide rail disposed on a bottom surface of said movable frame; first and second guide rollers for supporting and guiding said first guide rail, said first and second guide rollers being provided on said first and second reinforcing members; a pair of lateral shafts attached to sides of a front half portion of said movable frame; third guide rollers rotatably supported by said lateral shafts; a second guide rail on said bucket main body with said third guide roller rollably supported and guided thereon; vertical shafts on said bucket main body; fourth guide rollers rotatably supported by said vertical shafts and rollably abutted against right and left sides of said movable frame; and an adhered material removing member provided on said bucket main body and disposed above said sieve net and removing a material adhered to said sieve net.

13. An excavating, sieving and grading device for a working crawler comprising a bucket main body swingably mountable at an extreme end of an arm of the working crawler; an excavating blade formed at a front end of said bucket main body; a movable frame forwardly and backwardly movably disposed on a bottom opening of said bucket main body; a sieve net provided on said movable frame; a drive unit connected to said movable frame and mounted on said bucket main body for forwardly and backwardly reciprocatingly moving the movable frame; a pair of first right and left legs vertically disposed on a rear half portion of said bucket main body; said movable frame being located at all times integrally on said bucket main body; a first reinforcing member connecting said first right and left legs to each other; a first support and guide member for supporting and guiding a bottom surface of said movable frame provided on said first reinforcing member; a pair of second right and left legs vertically disposed on said bucket main body at a position forwardly of said first legs; a second reinforcing member connecting said second legs to each other; and a second support and guide member for supporting and guiding the bottom surface of said movable frame provided on said second reinforcing member.

14. An excavating, sieving and grading device for a working crawler according to claim 13, wherein said first and second support and guide members comprise first and second guide rollers.

15. An excavating, sieving and grading device for a working crawler according to claim 14, further comprising a first guide rail guided on said first and second guide rollers and being disposed on the bottom surface of said movable frame.

16. An excavating, sieving and grading device for a working crawler according to claim 13, further comprising third reinforcing members connecting said first and second front and rear legs to each other.

17. An excavating, sieving and grading device for a working crawler according to claim 15, further comprising a pair of lateral shafts attached to sides of a front half portion of said movable frame; third guide rollers rotatably supported by said lateral shafts; and second guide rails on said bucket main body with said third guide rollers rollably supported and guided thereon.

18. An excavating, sieving and grading device for a working crawler according to claim 17, further comprising vertical shafts on said bucket main body; fourth guide rollers rotatably supported by said vertical shafts and rollably abutted against right and left sides of said movable frame.

19. An excavating, sieving and grading device for a working crawler according to claim 18, further comprising third reinforcing members connecting said first and second front and rear legs to each other.

* * * * *